US005248121A

United States Patent [19]

Harrington

[11] Patent Number: 5,248,121

[45] Date of Patent: Sep. 28, 1993

[54] DUAL-PURPOSE SUPPORT APPARATUS FOR USE IN TAXIDERMY

[76] Inventor: Timothy J. Harrington, 9891 High Country Dr., Chardon, Ohio 44024

[21] Appl. No.: 917,571

[22] Filed: Jul. 21, 1992

[51] Int. Cl.[5] ..... A47G 1/24

[52] U.S. Cl. ..... 248/477; 40/160

[58] Field of Search ..... 248/477, 489, 494, 497, 248/498, 466, 475.1, 476, 496; 40/152.1, 153, 160; 434/296

[56] References Cited

U.S. PATENT DOCUMENTS

| | | | |
|---|---|---|---|
| 1,871,615 | 8/1932 | Jones | 248/475.1 X |
| 2,099,332 | 11/1937 | Nuccio | 248/493 X |
| 2,144,551 | 1/1939 | Skolnick | 40/160 X |
| 2,354,622 | 7/1944 | Swartz | 40/160 |
| 2,876,972 | 3/1959 | Silverman . | |
| 3,548,528 | 12/1970 | Belokin, Jr. . | |
| 3,566,526 | 3/1971 | La Violette . | |
| 3,822,494 | 9/1974 | Zivica | 40/160 X |
| 4,039,138 | 8/1977 | Einhorn | 248/497 |
| 4,211,022 | 7/1980 | Angelakos | 248/489 X |
| 4,408,992 | 10/1983 | Rinehart . | |
| 4,775,129 | 10/1988 | Gleisten | 248/493 |

FOREIGN PATENT DOCUMENTS 2158385 5/1973 Fed. Rep. of Germany ... 248/475.1

*Primary Examiner*—J. Franklin Foss

[57] ABSTRACT

An altogether new hanger is disclosed for use in the mounting of game fish and other fauna. Being comprised of a single sheet metal stamping 34, whose specific purpose is to provide a relief between the specimen and wall or plaque, whereby two distinct planes are created: one plane for attachment to the specimen, the other plane for attachment to a vertical surface, the two planes connected by a stand off portion for displacement of one plane from, the other, the connections being made by simple bending of the hanger material.

Final adjustment of the wall hanging is achieved by a multi-toothed cutout for placement over a wall nail. Tipping is eliminated by resilient polyurethane polymer bumpers in contact with a wall.

In addition, once the hanger is attached to the specimen, it may be used as a support on a worktable for finaling work on the specimen.

6 Claims, 2 Drawing Sheets

DUAL-PURPOSE SUPPORT APPARATUS FOR USE IN TAXIDERMY

BACKGROUND

1. Field of Invention

This invention relates to hangers used in taxidermy, specifically to such hangers that are used in the mounting of game fish. Additionally, the present invention is a workpiece support for use in prepairing the mounted specimen.

2. Description of Prior Art

Taxidermy Suppliers have a number of metal hangers available to taxidermists. These hangers are attached to a mounted specimen and then hung on a wall or plaque for display purposes.

Currently, all types of hanging devices available are substantially of a flat configuration. This flat configuration does not allow the specimen to be mounted in a natural position, as fins and gill covers must be mounted flat on the wall side or, at the very least, in a cramped, distorted pose. None of the hanging devices provide workpiece support for use during specimen preparation.

In addition, conventional hangers attached to a specimen make hanging difficult, their close proximity to the specimen obscures the nail or screw over which the hanger is to be placed.

Upon commissioning a patent search, very little prior art was found. U.S. Pat. No. 3,566,526 in 1971 to LaViolette teaches the use of a magnetic stand-off device for displaying a three-dimensional object. It does suggest a value to suspending an object away from the face of a surface, but the purpose seems to be more aesthetic or artistic than functional. Further, the stand-off devise of LaViolette is fixedly attached to a backboard and the displayed article is magnetically held to the affixed stand-off device. In contrast, the present invention is affixed to the displayed article and the resulting combination is to be removably hung on a nail or screw in the back board or wall.

U.S. Pat. No. 2,876,972 issued in 1959 to Silverman shows a mirror 10 suspended by means that hold it away from the back surface of the backing board 15. The means are twopiece supports 29 and 19 that interlock to suspend the mirror while holding it away from the back wall. This mirror and means of suspension seem irrelevent to my invention.

U.S. Pat. No. 4,775,129 issued in 1988 to Gleisten deals only with a framed article. It does not anticipate a new method for facilitating a more natural looking, lifelike mounted specimen, nor does it suggest supporting a specimen on a work surface.

Hangers in present use make it a precarious situation attempting to find the balance point of a mounted specimen. Further, they are often attached off-center which causes the mount to tip after it is placed on the wall.

In contrast to the prior art taxidermy supports the article of the invention comprises a stand-off type support for hanging a preserved game fish or other preserved fauna specimen in a realistic pose on a wall. The support is adopted to accept means, preferably auger screw means, for attaching it to the preserved specimen or the armature or body insert piece within the skin of said specimen. It is also adapted to accept means for removably attaching the support to a wall. Additionally, at least two optional cushions or pads are present and positioned to rest against the wall at two separated points substantially below the point of attachment to the wall. Between the part of the support contacting the wall and the part of the support contacting the specimen there is a stand-off portion of the support to displace the specimen from the wall by a distance that provides natural positioning of lateral fins and appendages—a specific feature not present in prior art taxidermy supports.

In practice, by virtue of its three-point suspension, the hanger may serve an additional function as a stand-off while the specimen is being processed on a workbench or other horizontal work surface, maintaining stable support of the specimen above the work surface; this is another feature of the present invention that is completely lacking in prior art taxidermy support devices. In both uses, the support acts as a stand-off to allow the positioning of the specimen in a natural pose while providing space between the specimen and the surface or wall for the natural positioning of lateral appendages, such as fins, gill covers, ears, legs, etc.

SUMMARY OF THE INVENTION

Accordingly, the reader will see that this invention can be used to hang a mounted specimen on a wall both effortlessly and conveniently. It also allows for a method of mounting that heretofore has been unknown. The new results obtained by the support of the invention are dramatic and long overdue.

Several objects and advantages of the present invention are:

(a) To provide a taxidermy support that creates a space between the mount and wall or plaque.

(b) To provide a relief for complete and natural extension of lateral appendages of the specimen being mounted.

(c) To provide a secure attachment of both the mounted specimen and the wall or plaque.

(d) To provide a vehicle for the mounting of specimens in unique and new positions heretofore unobtainable, i.e. both concave and convex mountings.

(e) To provide a method for finding the center of balance on a mounted specimen.

(f) To provide a means of supporting the mounted specimen on a table or easel, where additional mounting practices, such as painting or other finaling procedures, can be completed. As used herein, the term "finaling" refers to the final steps in preparing a mounted specimen. Finaling includes painting, final positioning of appendages, mouth, eyes, legs, ears, etc., and other final steps in the mounting process.

(g) To provide a hanger in various sizes to accomodate different sizes and species of mounts, mainly game fish, but not limited thereto.

In addition to the benefits previously stated, this invention lends itself to an ease of hanging the mount due to the large opening which is placed over the nail or other hanging devise. It has a multi-toothed design which can be used to level the mount if it is attached to the mount off-center.

The present invention also is of value to the taxidermist during the mounting process by providing a means for supporting the mount during painting or other work. Once attached to the mount, the invention keeps naturally extended appendages from coming into contact with a table or easel used as a work station, thereby preventing damage to the more delicate appendages.

In the wall-hanging mode of use, two resilient polyurethane polymer bumpers of the best mode act to cushion the bottom of the support device against the wall to dampen vibration from slamming doors, appliances, and the like, thereby keeping, the mount in the position in which it was intended.

Further objects and advantages of my support device will become apparent from a consideration of the drawings and ensuing description.

DETAILED DESCRIPTION OF THE PREFERRED EMBODIMENTS

In the best mode, the support of this invention is made simply from sheet metal bent in substantially a shape resembling a square wave, having two base portions that contact a surface, the two base portions bridged by a substantially flat crest portion that is in a plane substantially parallel to the plane of said two base portions and displaced therefrom. The crest portion has holes to receive auger screws that attach it to the specimen. One base portion has two pads and the other base portion has a hole or other means to receive a means for attaching it to a wall.

Figure 1:
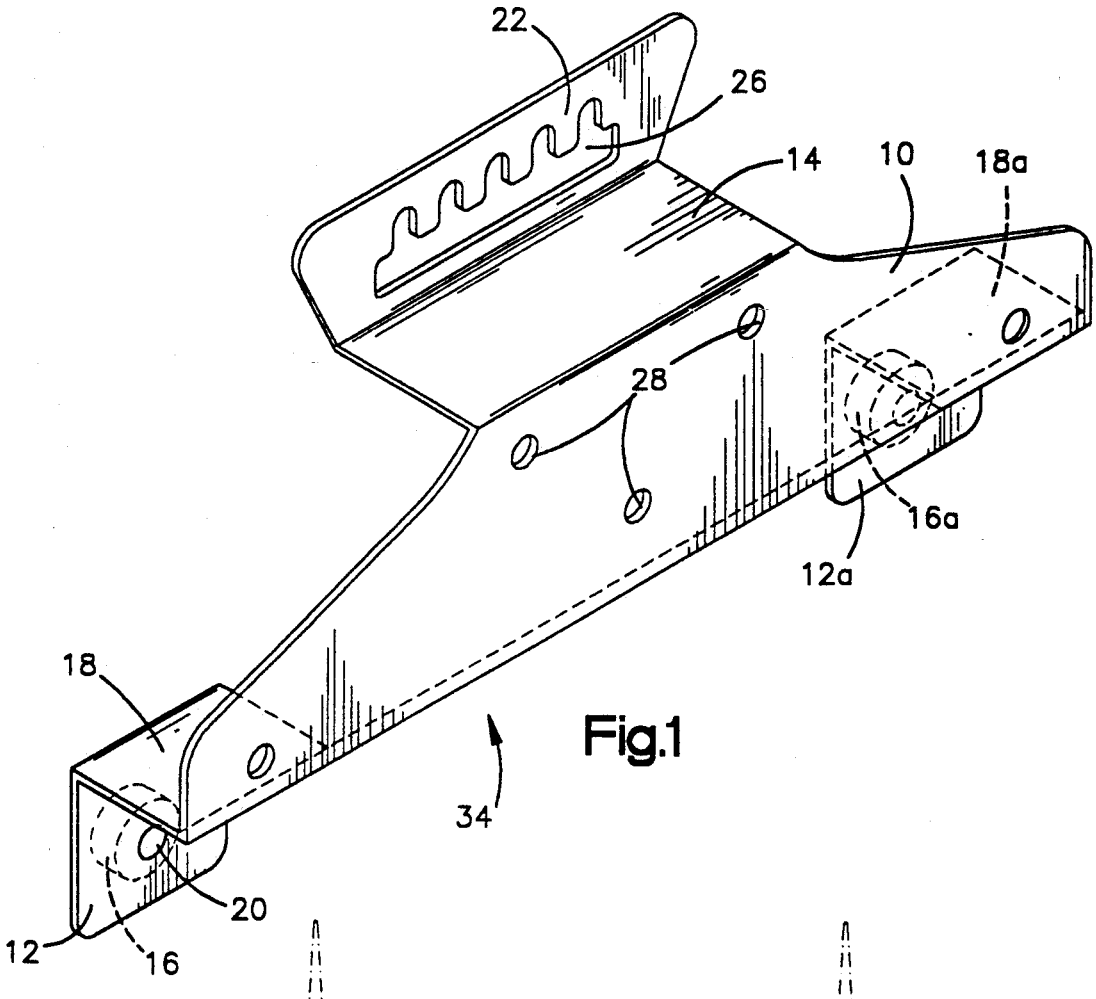
FIG. 1 is a perspective view of the present invention.
Figure 4:
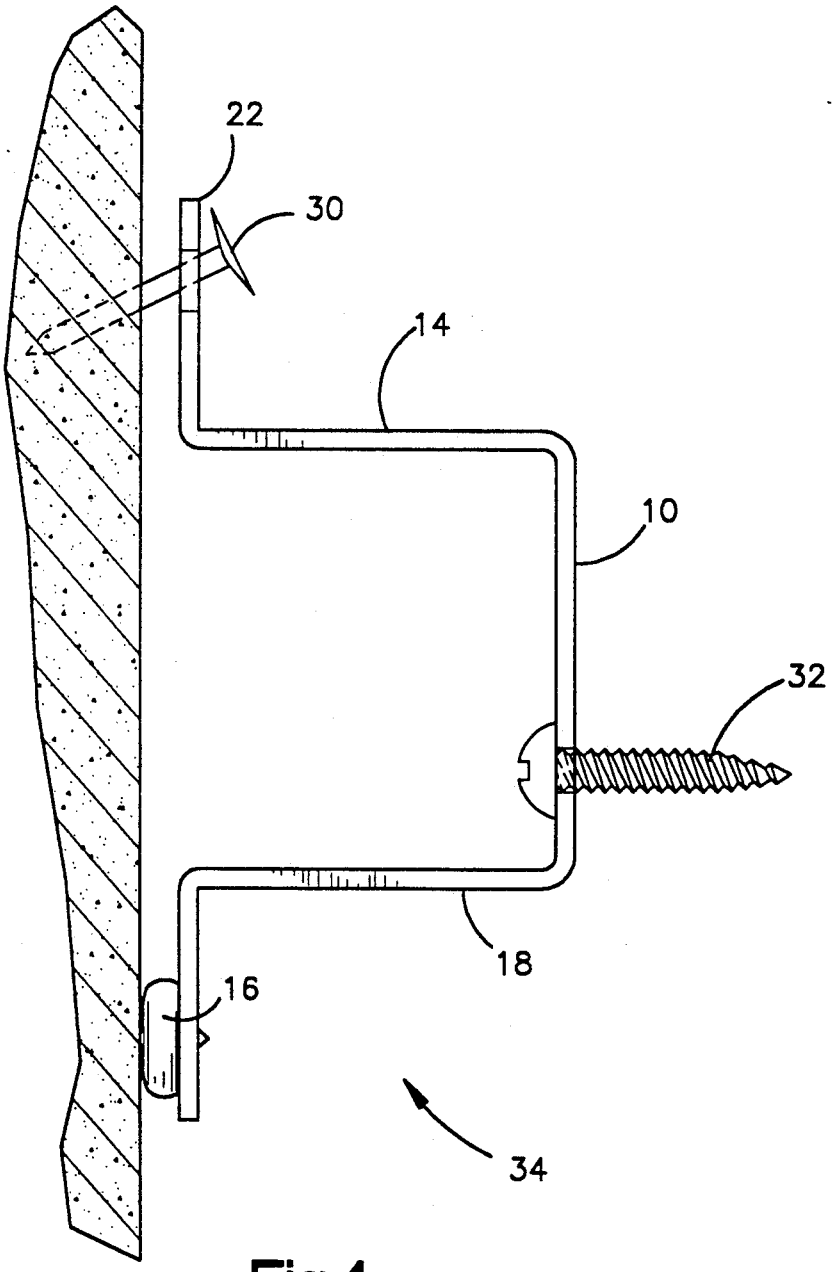
FIG. 4 is a side view of the present invention.

FIG. 1 shows a perspective view and FIG. 4 a side view of the support 34 of the present invention, which may comprise a single stamping from a sheet metal blank. A variation may be formed of plastic sheet or made by injection molding. The body of the support 34 has a upper portion 22 with a multi-toothed cutout 26 for removably engaging a wall nail 30. The body then bends outwardly from the plane 90° to form an upper horizontal extender 14, then downward 90° to form a mounting face 10. The mounting face 10 flares out laterally in both directions and has holes 28 to accept mounting screws 32. At each end of face 10, a lower horizontal extender 18 18*a* is formed that bends back 90° substantially parallel to and of substantially the same length as upper horizontal extender 14. Extenders 18 18*a* are then bent downward 90° to form wall plane bases 12 & 12*a*, which each have means to accept a resilient bumper 16 16*a*. Suitable bumpers are readily available in polyurethane from Hudson Industrial Products Inc. of Hudson, Ohio. It can readily be seen that the upper portion 22 and the two wall plane bases 12 & 12*a*, form a 3-point suspension for the body 34, in a tripod-like support.

The cantilevered effect of the design of the invention translates the weight of the attached mount 36 to the lower portion of the body 34 and to the resilient bumpers 16 16*a*, producing friction against lateral movement, thereby causing the mounted specimen to remain in the position in which it was placed.

Figure 2:
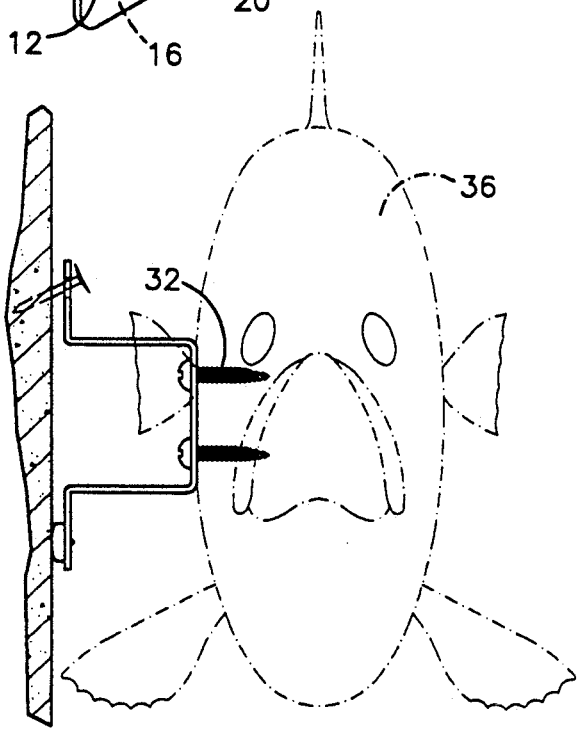
FIG. 2 is a side view of the present invention with mounted specimen.
Figure 3:
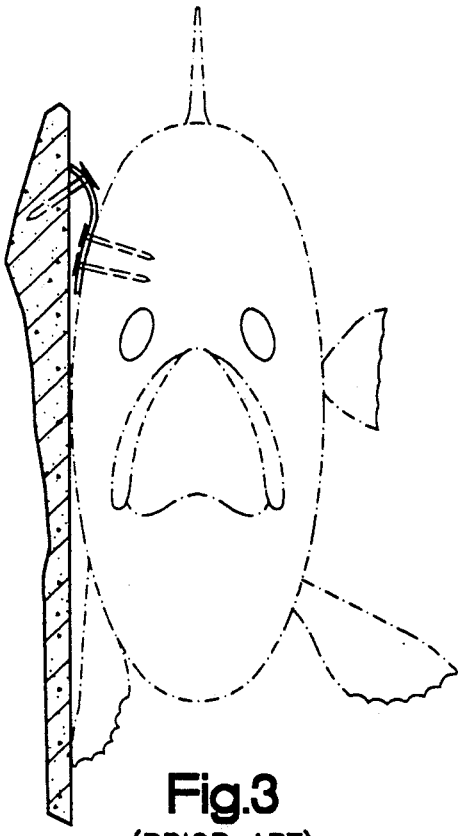
Fig.3 (PRIOR ART)
FIG. 3 is a view of a mounted specimen with prior art mounting means.

The purpose of the present invention may be clearly seen by comparing FIG. 2, which shows the support of the present invention as it is used, and FIG. 3, which shows the prior art support as it is used. It is clear that the posing of the specimen in FIG. 3 is cramped and unnatural, necessitated by the close proximity to the wall. In contrast, the use of the present invention as shown in FIG. 2, the appendages may be positioned in a normal position and the specimen may be more naturally posed.

The purpose for using the taxidermy support 34 is similar to that for using those hangers presently in use—namely, to attach a mounted specimen to a wall for display purposes.

Furthermore, the support has the additional advantages in that:

it creates a space between the wall and mount, giving a more three-dimensional look;

it permits, by providing the aforementioned space, the free and natural lateral extension of appendages, which extension was heretofore compromised;

it provides secure attachment to both the mounted specimen and the wall;

it permits the mounting of specimens in new, more lifelike positions;

it facilitates an ease of hanging to both the taxidermist and the collector of mounted wildlife;

it provides a hanger that, due to increased friction produced by the cantilever effect of the mounted specimen, will not tip when hung on a wall; and it permits a supporting of the specimen for finishing work not allowed by other hangers.

In practice, the three-point suspension of the support of this invention serves the taxidermist as a useful tool to totally support the specimen above a substantially horizontal work surface in a pose just as the finished specimen will appear when held by the support when it is hung on a wall. In this working support mode, the support firstly acts as an aid to find the approximate center of gravity or balance point of the specimen, thereby to assure stable hanging of the finished mounting. Secondly, in the working support mode, after the specimen is firmly attached to the support, the support provides means to handle the specimen to adjust its positioning and to paint and otherwise make final preparation of it for display thereof. These functions are not provided by any prior art taxidermy supports.

To help the reader fully understand the advantages of the present invention, I shall explain the method of using it.

First, a support 34 is laid upon a table or other substantially horizontal work surface on its wall side, the plane formed by 22, 12 & 12*a*. Next a mounted specimen is rested upon the mounting face 10 in such a way that it will above the work surface balance and be of the desired attitude selected by the taxidermist. Now, by gripping the support 34 and mount 36 together, they may be lifted up as one unit so that marks may be made with a marking pen (or other marking device) through the holes 28 provided for attachment, thereby to insure exact placement of the support 34 on the mounted specimen. The support may then be attached precisely with auger type screws 32 or other similar fasteners.

Once the support 34 is securely fastened to the mounted specimen, it can be used to support the specimen above a horizontal work surface for finaling procedures of the mounting process. It can be easily turned in a complete circle allowing the taxidermist to work on the mount from all angles or directions while he remains seated in one position.

When work is completed on the mount and it is ready to be hung upon a wall, the two resilient polyurethane polymer bumpers 16 and 16*a* can be attached to the wall plane bases 12 and 12*a*.

The mounted specimen with support 34 attached may now be placed over a wall nail which was left protruding from the wall substantially the distance of the width of the resilient polyurethane polymer bumper 16. Some flexibility in adjusting the attitude of the specimen on the wall is provided by the multi-toothed cutout 26 and by adjusting the protrusion of the wall-engaging nail 30.

If attaching the support 34 to a plaque rather than a wall, the above procedure may be followed. Instead of resilient polyurethane polymer bumpers 16, two screws of the proper size nay be used to affix the wall plane bases 12 and 12*a* to the plaque.

Although the description above contains many specificities, these should not be construed as limiting the scope of the invention but merely providing illustration of some of the presently, preferred embodiments of the invention. For example, the support can have other shapes, such as mere design changes, or could be made from other material such as brass, copper, tin, wire, plastic, or combinations thereof, or a support which is adjustable in its ability to hold a given distance away from a wall or plaque, etc. Thus, the scope of the invention should be determined by the appended claims and their legal equivalents, rather than by the examples given.

I claim:

1. A support for a mounted preserved fauna specimen, such as a game fish or the like, said support comprising a first planar surface-engaging means having wall fastener engaging means, and a coplanar second planar surface-engaging means, said first and second surface-engaging means connected and bridged by a standoff means having a medially-located specimen-engaging face that is substantially parallel to the plane of said first and second surface-engaging means, said standoff means providing displacement of said specimen-engaging face from said plane, thereby to provide sufficient space for the natural positioning of appendages of said specimen, and whereby said support may be alternatively used on a substantially horizontal surface as a specimen support to fully support said specimen above said horizontal surface during preparation of the specimen for display on a vertical surface, such as a wall, for display of the specimen.

2. A support for a mounted preserved fauna specimen, such as a game fish or the like, said support comprising a first planar surface-engaging means having wall fastener engaging means, and a coplanar second planar surface-engaging means, said first and second surface-engaging means connected and bridged by a standoff means having a medially-located specimen-engaging face that is substantially parallel to the plane of said first and second surface-engaging means, said standoff means providing displacement of said specimen-engaging face from said plane, whereby said support may be alternatively used on a substantially horizontal surface as a specimen support during preparation of the specimen for display on a vertical surface, such as a wall, for display of the specimen, and wherein the portion of said standoff means between said specimen-engaging face and said second surface-engaging means is bifurcated so that two laterally-spaced second surface-engaging means are present, thereby to provide a tripod-like support.

3. A support for a mounted preserved fauna specimen, such as a game fish or the like, said support comprising a first planar surface-engaging means having wall fastener engaging means, and a coplanar second planar surface-engaging means, said first and second surface-engaging means connected and bridged by a standoff means having a medially-located specimen-engaging face that is substantially parallel to the plane of said first and second surface-engaging means, said standoff means providing displacement of said specimen-engaging face from said plane, whereby said support may be alternatively used on a substantially horizontal surface as a specimen support during preparation of the specimen for display on a vertical surface, such as a wall, for display of the specimen, and wherein said second surface-engaging means includes plural resilient friction pads to inhibit lateral movement of the support when it rests upon a surface.

4. The support device of claim 3 wherein said friction pads are of polyurethane polymer.

5. A support for a mounted preserved fauna specimen, such as a game fish or the like, said support comprising a first planar surface-engaging means having wall fastener engaging means, and a coplanar second planar surface-engaging means, said first and second surface-engaging means connected and bridged by a standoff means having a medially-located specimen-engaging face that is substantially parallel to the plane of said first and second surface-engaging means, said standoff means providing displacement of said specimen-engaging face from said plane, whereby said support may be alternatively used on a substantially horizontal surface as a specimen support during preparation of the specimen for display on a vertical surface, such as a wall, for display of the specimen, and wherein said wall fastener engaging means comprises a hole through said first surface-engaging means.

6. The support of claim 1 wherein said wall fastener engaging means comprises a multi-toothed design, thereby to provide multiple selectable suspension points to properly level the specimen as it is hung on a wall.

* * * * *